US011006752B2

(12) United States Patent
Ye

(10) Patent No.: US 11,006,752 B2
(45) Date of Patent: May 18, 2021

(54) MULTIFUNCTIONAL BALANCE CHAIR

(71) Applicant: Longhua Ye, Fujian (CN)

(72) Inventor: Longhua Ye, Fujian (CN)

( * ) Notice: Subject to any disclaimer, the term of this patent is extended or adjusted under 35 U.S.C. 154(b) by 0 days.

(21) Appl. No.: 16/665,080

(22) Filed: Oct. 28, 2019

(65) Prior Publication Data

US 2020/0054138 A1 Feb. 20, 2020

Related U.S. Application Data

(63) Continuation of application No. PCT/CN2018/078109, filed on Mar. 6, 2018.

(30) Foreign Application Priority Data

Apr. 27, 2017 (CN) ..... 201710286641.1
Apr. 27, 2017 (CN) ..... 201720455374.1

(51) Int. Cl.

| | |
|---|---|
| ***A47C 1/032*** | (2006.01) |
| ***A47C 1/024*** | (2006.01) |
| ***A47C 3/18*** | (2006.01) |
| ***A47C 9/00*** | (2006.01) |
| ***A47C 3/20*** | (2006.01) |

(52) U.S. Cl.

CPC ..... *A47C 1/03255* (2013.01); *A47C 1/024* (2013.01); *A47C 3/18* (2013.01); *A47C 3/20* (2013.01); *A47C 9/005* (2013.01)

(58) Field of Classification Search

CPC ..... A47C 9/005; A47C 1/03255; A47C 1/024; A47C 3/18; A47C 7/024; A47C 1/0342; A47C 3/20

See application file for complete search history.

(56) References Cited

U.S. PATENT DOCUMENTS 7,887,136 B2 * 2/2011 Zoell ..... A47C 4/022 297/423.12
9,345,332 B2 * 5/2016 Kieryllo ..... A47C 7/024

FOREIGN PATENT DOCUMENTS

| | | | |
|---|---|---|---|
| CN | 2390484 | Y | 8/2000 |
| CN | 201143047 | Y | 11/2008 |
| CN | 102599746 | A | 7/2012 |
| CN | 203058966 | U | 7/2013 |

(Continued)

OTHER PUBLICATIONS

International Search Report and Written Opinion with English Translation of ISR, cited in PCT/CN2018/078109 dated May 31, 2018, 10 pages.

*Primary Examiner* — Milton Nelson, Jr.
(74) *Attorney, Agent, or Firm* — Cooper Legal Group, LLC

(57) ABSTRACT

The present disclosure discloses a multifunctional balance chair comprising a support portion, a seat portion, and a kneeling cushion portion. The seat portion is movably connected to the support portion, and an angle between the seat portion and the horizontal plane is controlled by relative movement between the seat portion and the support portion. The kneeling cushion portion is movably connected to the seat portion and connected to the support portion by a connecting mechanism. The kneeling cushion portion is movable between a first position aligned with the seat portion and a second position in which the kneeling cushion portion constitutes a balance chair cushion. The movement of the seat portion is linked to movement of the kneeling cushion portion.

20 Claims, 10 Drawing Sheets

(56) References Cited

FOREIGN PATENT DOCUMENTS

| | | | | | |
|---|---|---|---|---|---|
| CN | 204071221 | U | | 1/2015 | |
| CN | 204192040 | U | | 3/2015 | |
| CN | 107149315 | A | | 9/2017 | |
| FR | 1151003 | A | * | 1/1958 | ..... A47C 1/0342 |
| JP | 2010099102 | A | | 5/2010 | |
| WO | WO-8500275 | A1 | * | 1/1985 | ..... A47C 9/005 |

* cited by examiner

MULTIFUNCTIONAL BALANCE CHAIR

RELATED APPLICATIONS

This application is a continuation of and claims priority to PCT Patent Application PCT/CN2018/078109, filed on Mar. 6, 2018, which claims priority to Chinese Patent Application 201710286641.1 and Chinese Patent Application 201720455374.1, both filed on Apr. 27, 2017. PCT Patent Application PCT/CN2018/078109, Chinese Patent Application 201710286641.1, and Chinese Patent Application 201720455374.1 are incorporated herein by reference.

FIELD OF THE DISCLOSURE

The present disclosure relates to the field of furniture, and in particular the present disclosure relates to a multifunctional balance chair.

BACKGROUND OF THE DISCLOSURE

The conventional balance chair comprises a leg frame, a backrest disposed on the leg frame, a seat portion disposed on the leg frame, and a kneeling cushion portion disposed on the leg frame. The conventional balance chair has only a single function. Therefore, there is room for improvement.

In view of the aforementioned deficiencies, a solution has been proposed. A variable balance chair, disclosed in Chinese Patent Publication CN2390484Y, comprises a seat plate, a bracket, and a backrest. A rear seat plate adjustment sleeve of the bracket is connected to a rear support bar of the bracket in a lifting and lowing manner. The seat plate and the bracket are connected in a positioning and embedding method, and a knee and leg cushion is disposed on a position of the bracket near knees and legs of a user when the user is sitting. Although the variable balance chair can be switched between a seat state and a balance chair state, when used in a seat state, the presence of the knee and leg cushion interferes with the placement of the seat for the user, resulting in discomfort to the user. Moreover, if the sitting area is too small, the user will be uncomfortable.

BRIEF SUMMARY OF THE DISCLOSURE

The present disclosure provides a multifunctional balance chair to solve deficiencies of the multifunctional balance chair of the existing techniques.

In order to solve the aforementioned technical problems, the technical solution adopted by the present disclosure is as follows:

A multifunctional balance chair, comprising a support portion, a seat portion, and a kneeling cushion portion, wherein the seat portion is movably connected to the support portion and movement of the seat portion is configured to control an angle between the seat portion and a horizontal plane, the kneeling cushion portion is movably connected to the seat portion, the kneeling cushion portion is connected to the support portion by a connecting mechanism, the kneeling cushion portion is movable between a first position aligned with the seat portion and a second position in which the kneeling cushion portion acts as a kneeling cushion of the multifunctional balance chair, and the movement of the seat portion is linked to movement of the kneeling cushion portion.

In a preferred embodiment, the seat portion is rotatably connected to the support portion, and the kneeling cushion portion is rotatably connected to the seat portion.

In a preferred embodiment, the multifunctional balance chair further comprises an extendable mechanism, wherein a first end of the extendable mechanism is rotatably connected to the support portion, and a second end of the extendable mechanism is rotatably connected to the seat portion.

In a preferred embodiment, the multifunctional balance chair further comprises a bracket connected to the support portion and a sliding seat, wherein the sliding seat is slidable relative to the bracket, the seat portion is connected to a first sliding bar that is slidable relative to the seat portion, and the first sliding bar is connected to the sliding seat.

In a preferred embodiment, the bracket is shaped as an arc, a circle center of the arc is disposed on a rotation axis of the seat portion.

In a preferred embodiment, the multifunctional balance chair further comprises a backrest, wherein the backrest is disposed on the bracket.

In a preferred embodiment, the multifunctional balance chair further comprises two armrests, wherein the two armrests are disposed on the bracket.

In a preferred embodiment, the multifunctional balance chair further comprises a backrest, wherein the backrest comprises at least one second sliding bar configured to slide downward, a lower end of each of the at least one second sliding bar is configured to be rotatably connected to the support portion, and a rear portion of the seat portion is configured to be rotatably connected to the backrest.

In a preferred embodiment, the connecting mechanism comprises at least one synchronous connecting rod, a first end of each of the at least one synchronous connecting rod is rotatably connected to the kneeling cushion portion, and a second end of each of the at least one synchronous connecting rod is connected to the support portion and configured to rotate relative to the support portion.

In a preferred embodiment, a middle portion of a front end of the seat portion is provided with a protruding portion, a middle portion of a rear end of the kneeling cushion portion is provided with a concave portion, and when the kneeling cushion portion is in the first position aligned with the seat portion, the concave portion of the kneeling cushion portion is coupled to the protruding portion of the seat portion.

In a preferred embodiment, the seat portion is rotatably connected to the support portion, a middle portion of a front end of the seat portion is provided with a protruding portion, a middle portion of a rear end of the kneeling cushion portion is provided with a concave portion, and when the kneeling cushion portion is in the first position aligned with the seat portion: the concave portion of the kneeling cushion portion is coupled to the protruding portion of the seat portion, and a rotation axis between the kneeling cushion portion and the seat portion passes through a front portion of the protruding portion and a front portion of the concave portion.

In a preferred embodiment, at least one link support arm is disposed under a front portion of the kneeling cushion portion, the connection mechanism comprises at least one synchronous connecting rod, a first end of each of the at least one synchronous connecting rod is rotatably connected to a corresponding one of the at least one link support arm, and a second end of each of the at least one synchronous connecting rod is rotatably connected to the support portion.

Compared with existing techniques, the technical solution has the following advantages:

The seat portion is movably connected to the support portion and the angle between the seat portion and the horizontal plane can be controlled by relative movement between the seat portion and the support portion. The kneeling cushion portion is movably connected to the seat portion, and the kneeling cushion portion is connected to the support portion by a connecting mechanism. The kneeling cushion portion is movable between a first position aligned with the seat portion and a second position in which the kneeling cushion portion acts as a kneeling cushion of the multifunctional balance chair. The movement of the seat portion is linked to movement of the kneeling cushion portion. When the kneeling cushion portion is in the first position aligned with the seat portion, that is, when the multifunctional balance chair is in the seat chair state such that the multifunctional balance chair functions as a conventional chair on the market, a seat of the multifunctional balance chair comprises the seat portion and the kneeling cushion portion, which increases an area of the seat and avoids an interference of the kneeling cushion portion on two legs of the user. When the kneeling cushion portion is in the second position in which the kneeling cushion portion acts as a kneeling cushion of the multifunctional balance chair, that is, when the seat portion of the multifunctional balance chair is obliquely arranged, an inclined face of the seat portion faces forward, the kneeling cushion portion is obliquely arranged, and an inclined face of the kneeling cushion portion faces backward, the user sits on the seat portion and two legs of the user are supported on the kneeling cushion portion. Thus, when the kneeling cushion portion is in the second position, the multifunctional balance chair is in a balance chair state such that the multifunctional balance chair functions as a conventional balance chair on the market.

The seat portion is configured to be rotatably connected to the support portion, and the kneeling cushion portion is configured to be rotatably connected to the seat portion. Thus, a structure of the multifunctional balance chair is simple and compact, and the multifunctional balance chair is able to be manufactured at a low cost.

The first end of extendable mechanism is configured to be rotatably connected to the support portion, and the second end of extendable mechanism is configured to be rotatably connected to the rear portion of the seat portion. Thus, the structure of the multifunctional balance chair is simple and compact, and the multifunctional balance chair is able to be manufactured at low cost.

A sliding seat can slide relative to the bracket, and the seat portion is connected to the first sliding bar which can slide relative to the seat portion, and the first sliding bar is connected to the sliding seat. The structure of the multifunctional balance chair is simple and compact, and the multifunctional balance chair is able to be manufactured at low cost.

The multifunctional balance chair further comprises a backrest. The backrest is provided with at least one second sliding bar which can slide downward. A lower end of each of the at least one second sliding bar is configured to be rotatably connected to the support portion, and a rear portion of the seat portion is configured to be rotatably connected to the backrest. An angle of the backrest in the balance chair state and an angle of the backrest in the seat chair state are different, so that the user feels comfortable in both states.

The connecting mechanism comprises at least one synchronous connecting rod. A first end of each of the at least one synchronous connecting rod is rotatably connected to the kneeling cushion portion, and a second end of each of the at least one synchronous connecting rod is connected to the support portion and configured to rotate relative to the support portion. A structure of the connecting mechanism is simple.

A middle portion of a front end of the seat portion is provided with a protruding portion, and a middle portion of a rear end of the kneeling cushion portion is provided with a concave portion. When the kneeling cushion portion is in the first position aligned with the seat portion, the concave portion of the kneeling cushion portion is coupled to the protruding portion of the seat portion, and a rotation axis between the kneeling cushion portion and the seat portion passes through a front portion of the protruding portion and a front portion of the concave portion. A tilt angle of the kneeling cushion portion and a tilt angle of the seat portion are synchronously changed in opposite directions.

At least one link support arm is disposed under a front portion of the kneeling cushion portion. A first end of each of the at least one synchronous connecting rod is rotatably connected to a corresponding one of the at least one link support arm of the kneeling cushion portion, and a second end of each of at least one the synchronous connecting rod is rotatably connected to the support portion. An assembly of the connecting mechanism is easy, and an arrangement of the connecting mechanism is reasonable.

The disk comprises a disk body and a cantilever disposed on a front lower portion of the disk body, and the kneeling cushion portion is connected to a bottom end of the cantilever by the connecting mechanism. An assembly of the disk is easy, and an arrangement of the disk is reasonable.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Figure 1:
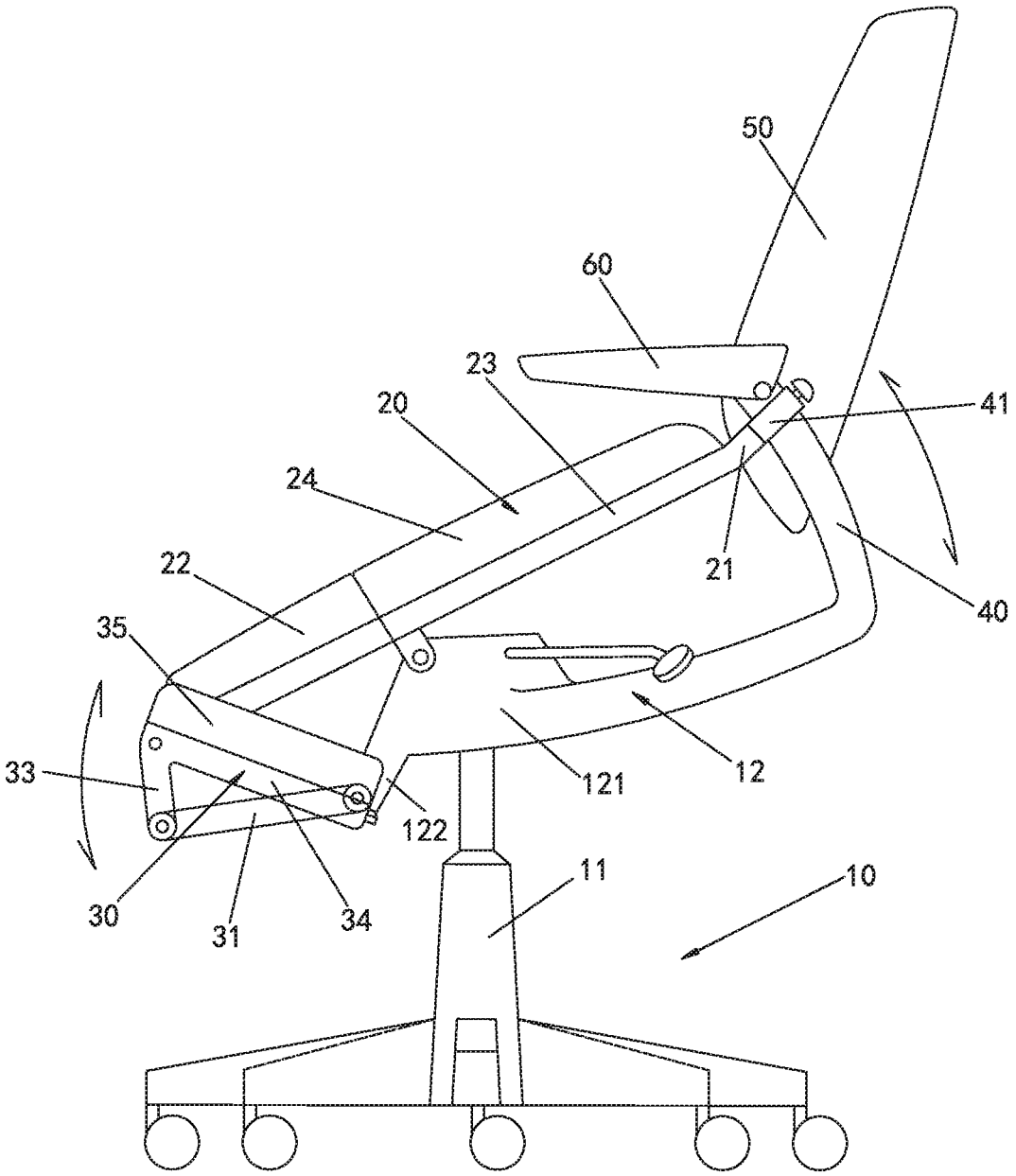
FIG. 1 illustrates a schematic view of a multifunctional balance chair of Embodiment 1 when the multifunctional balance chair is in a balance chair state.
Figure 2:
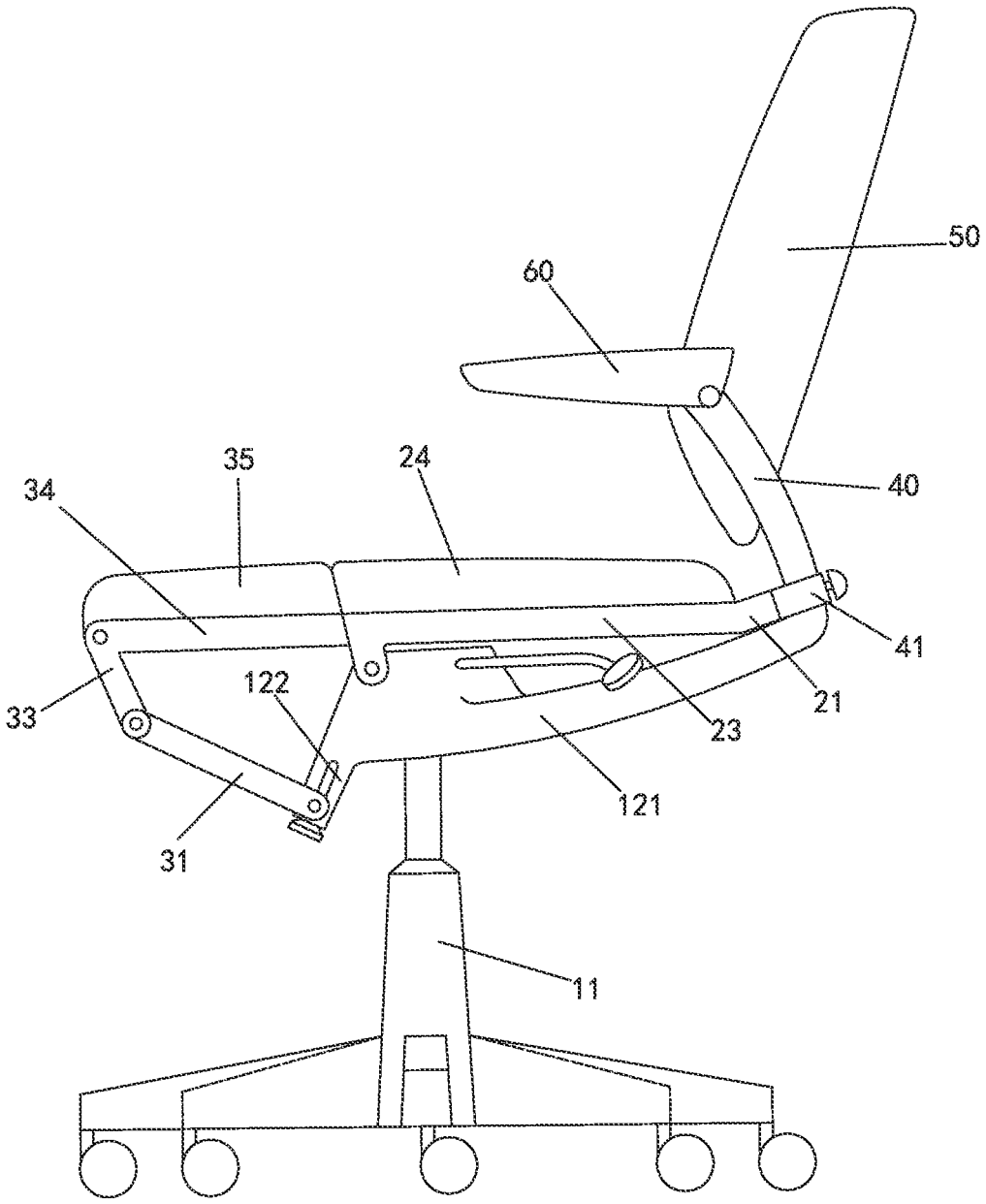
FIG. 2 illustrates a schematic view of the multifunctional balance chair of Embodiment 1 when the multifunctional balance chair is in a seat chair state.
Figure 3:
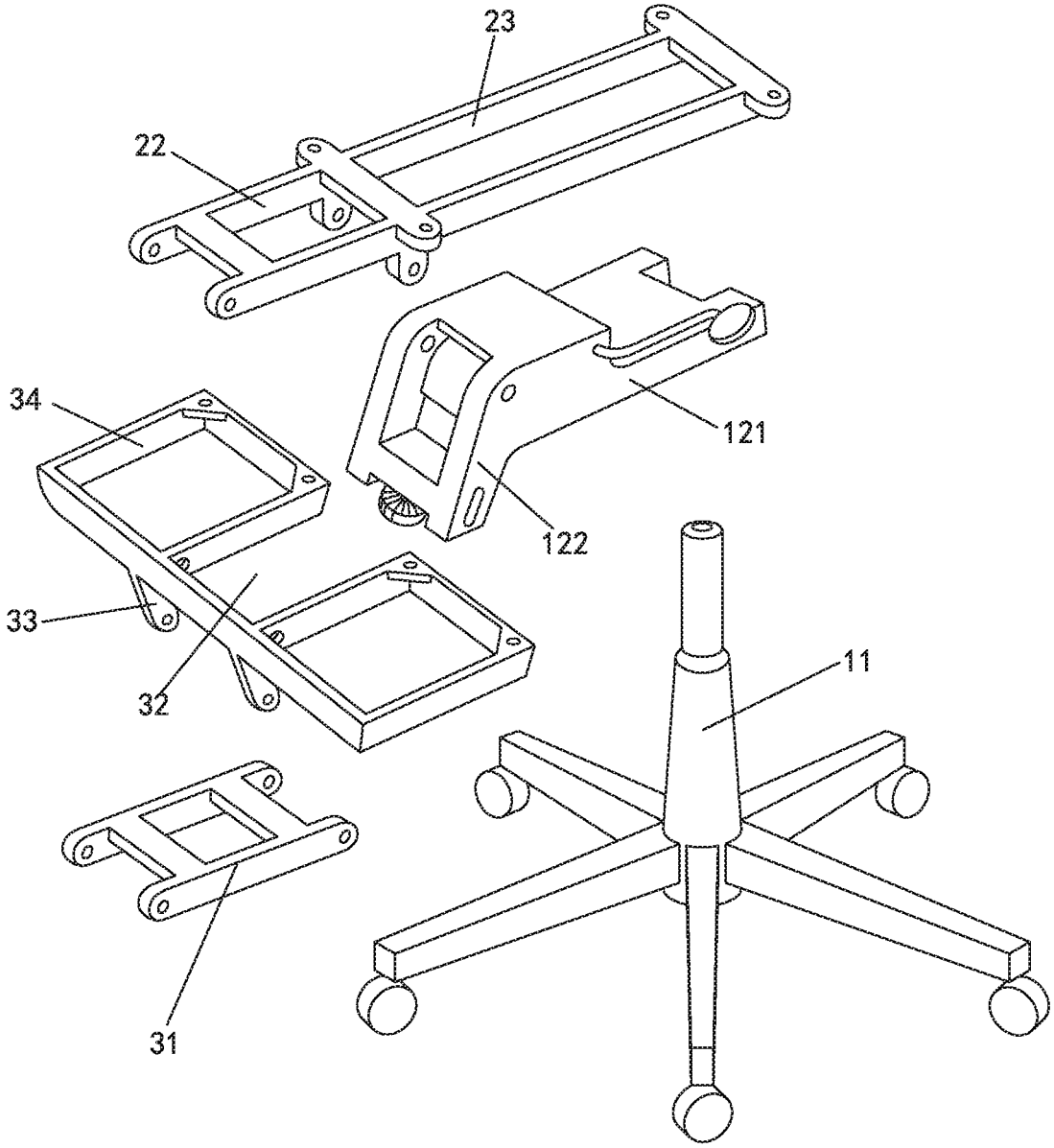
FIG. 3 illustrates an exploded view of components of a portion of the multifunctional balance chair of Embodiment 1.

Referring to FIGS. 1-3, a multifunctional balance chair comprises a support portion 10, a seat portion 20 and a kneeling cushion portion 30. The seat portion 20 is rotatably connected to the support portion 10, and an angle between the seat portion 20 and the horizontal plane is controlled by relative movement between the seat portion 20 and the support portion 10. The kneeling cushion portion 30 is rotatably connected to the seat portion 20, and the kneeling cushion portion 30 is connected to the support portion 10 by a connecting mechanism. The kneeling cushion portion 30 moves between a first position in which the kneeling cushion portion 30 is aligned with the seat portion 20 and a second position in which the kneeling cushion portion 30 acts as a kneeling cushion of the multifunctional balance chair. Movement of the seat portion 20 is linked to movement of the kneeling cushion portion 30, so that an angle between the kneeling cushion portion 30 and the horizontal plane and the angle between seat portion 20 and the horizontal plane can be synchronously changed in opposite directions. By way of example, when the seat portion 20 is inclined in a forward direction at an angle of 30-40 degrees, the seat portion 20 is locked. In this embodiment, the seat portion 20 can rotatably connect to the support portion 10, and the kneeling cushion portion 30 can rotatably connect to the seat portion 20. Thus, a structure of the multifunctional balance chair is simple and compact, and the multifunctional balance chair is able to be manufactured at a low cost.

Referring to FIG. 2, when the kneeling cushion portion 30 is in the first position such that the kneeling cushion portion 30 is aligned with the seat portion 20, the multifunctional balance chair is in a seat chair state that functions as a conventional chair on the market. A seat of the multifunctional balance chair comprises the seat portion 20 and the kneeling cushion portion 30. This increases an area of the seat and avoids an interference of the kneeling cushion portion 30 on two legs of the user. Referring to FIG. 1, when the kneeling cushion portion 30 is in the second position such that the kneeling cushion portion 30 acts as a kneeling cushion of the multifunctional balance chair, the seat portion 20 of the multifunctional balance chair is obliquely arranged and an inclined face of the seat portion 20 faces forward, and the kneeling cushion portion 30 is obliquely arranged and an inclined face of the kneeling cushion portion 30 faces backward. The user sits on the seat portion 20, two legs of the user are supported on the kneeling cushion portion 30, and the multifunctional balance chair is in a balance chair state, thus functioning as a conventional balance chair on the market.

In this embodiment, the multifunctional balance chair further comprises a bracket 40 connected to the support portion 10 and a sliding seat 41. The bracket 40 is shaped as an arc, and a circle center of the arc is disposed on a rotation axis of the seat portion 20. The sliding seat 41 is slidable relative to the bracket 40, and the seat portion 20 is connected to a first sliding bar 21 that is slidable relative to the seat portion 20. The first sliding bar 21 is fixedly or rotatably connected to the sliding seat 41. When the sliding seat 41 slides relative to the bracket 40, the seat portion 20 is driven to rotate relative to the support portion 10. The multifunctional balance chair further comprises a backrest 50 and two armrests 60. The backrest 50 is disposed on the bracket 40, and the two armrests 60 are disposed on the bracket 40. By way of example, the backrest 50 is fixedly or rotatably disposed on the bracket 40, and the two armrests 60 are fixedly or rotatably disposed on the bracket 40. In this embodiment, the sliding seat 41 can slide relative to the bracket 40, the seat portion 20 is connected to the first sliding bar 21 which can slide relative to the seat portion 20, and the first sliding bar 21 is connected to the sliding seat 41. The structure of the multifunctional balance chair is simple and compact, and the multifunctional balance chair is able to be manufactured at low cost. The backrest 50 comprises at least one second sliding bar 51 which can slide downward, a lower end of each of the at least one second sliding bar 51 can be rotatably connected to the support portion 10, and a rear portion of the seat portion 20 can be rotatably connected to the backrest 50. An angle of the backrest 50 when the multifunctional balance chair is in the balance chair state and an angle of the backrest when the multifunctional balance chair is in the seat chair state are different, so that the user feels comfortable in both states.

In this embodiment, the connecting mechanism comprises at least one synchronous connecting rod 31. A first end of each of the at least one synchronous connecting rod 31 is rotatably connected to the kneeling cushion portion 30, and a second end of each of the at least one synchronous connecting rod 31 is connected to the support portion 10 and can rotate relative to the support portion 10. A middle portion of a front end of the seat portion 20 is provided with a protruding portion 22, and a middle portion of a rear end of the kneeling cushion portion 30 is provided with a concave portion 32. When the kneeling cushion portion 30 is in the first position such that the kneeling cushion portion 30 is aligned with the seat portion 20, the concave portion 32 of the kneeling cushion portion 30 is coupled to the protruding portion 22 of the seat portion 20, and the seat portion 20 and the kneeling cushion portion 30 combine together to form a complete seat. In a preferred embodiment, a rotation axis between the kneeling cushion portion 30 and the seat portion 20 passes through a front portion of the protruding portion 22 and a front portion of the concave portion 32. At least one link support arm 33 is disposed under a front portion of the kneeling cushion portion 30. A first end of each of the at least one synchronous connecting rod 31 is rotatably connected to a corresponding one of the at least one link support arm 33 of the kneeling cushion portion 30, and a second end of each of at least one the synchronous connecting rod 31 is rotatably connected to the support portion 10. A connection between the second end of the synchronous connecting rod 31 and the support portion 10 is, for example, a direct rotation connection, or if the support portion 10 is provided with a slide slot and a pivot and an adjustment mechanism are further provided, the second end of each of the at least one synchronous connecting rod 31 is rotatably connected to the pivot. The pivot is movably connected to the slide slot, the adjustment mechanism connects to the pivot and the support portion 10 to adjust a position of the pivot relative to the slide slot, and a relative position of the rotation axis between the second end of the synchronous connecting rod 31 and the support portion 10 can be changed by the adjustment mechanism and the slide slot. In this embodiment, a structure of the connecting mechanism is simple, an assembly of the connecting mechanism is easy, and an arrangement of the connecting mechanism is reasonable.

Figure 5:
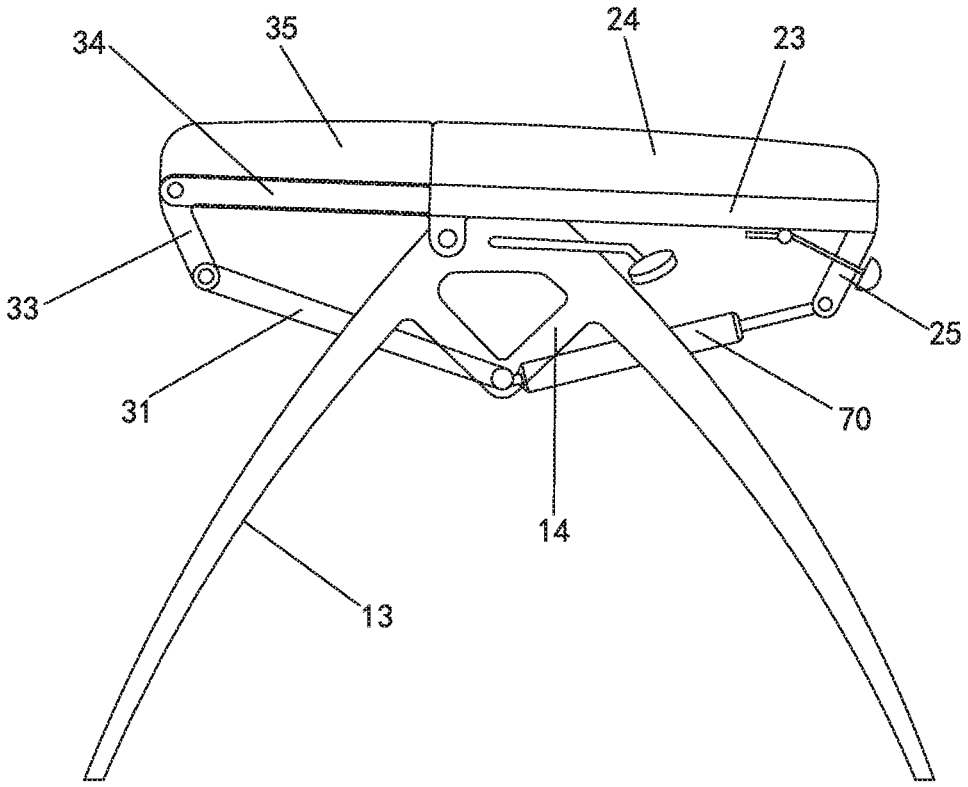
FIG. 5 illustrates a schematic view of the multifunctional balance chair of Embodiment 2 when the multifunctional balance chair is in a seat chair state.

In a specific structure, the support portion 10 comprises a support frame 11 and a disk 12 disposed on the support frame 11. The support frame 11 is a leg of a wheeled chair as shown in FIG. 1 or FIG. 2 or a herringbone leg as shown in FIG. 5. The disk 12 comprises a disk body 121 and a cantilever 122 disposed at a front lower portion of the disk body 121. The seat portion 20 is rotatably connected to the disk body 121, and the second end of each of the at least one synchronous connecting rod 31 is connected to a bottom end of the cantilever 122.

As needed, at least one first locking mechanism is disposed between the seat portion 20 and the support portion 10 (such as the disk body 121) and/or between the sliding seat 41 and the bracket 40 and/or between the first sliding bar 21 and the seat portion 20. The at least one first locking mechanism is configured to hold the multifunctional balance chair in the balance chair state or the seat chair state when locked, and the state of the multifunctional balance chair can be changed by unlocking the at least one first locking mechanism. Each of the at least one first locking mechanism adopts a system of a locking hole and a latch that interacts with the locking hole. Each of the at least one first locking mechanism is locked when a corresponding one of the latch is inserted into a corresponding one of the locking hole, and each of the at least one first locking mechanism is unlocked when a corresponding one of the latch is pulled out from a corresponding one of the locking hole. Further, as needed, a second locking mechanism may also be disposed between the seat portion 20 and the kneeling cushion portion 30.

In a specific structure of this embodiment, the seat portion 20 comprises the protruding portion 22, a cushion bridge 23 and a seat cushion 24 disposed on the cushion bridge holder 23. The seat cushion 24 has a convex structure, and the seat cushion 24 is disposed on the cushion bridge holder 23 and the protruding portion 22. The cushion bridge holder 23 and the protruding portion 22 can be integrally formed. The kneeling cushion portion 30 comprises a cushion holder 34 and two cushions 35. The cushion holder 34 has a concave structure, and the two cushions 35 are respectively disposed on a left portion and a right portion of the cushion holder 34. The support arm 33 is disposed below a front end of the cushion holder 34. The rotation axis between the kneeling cushion portion 30 and the seat portion 20 passes through a front portion of the protruding portion 22 and a front end of the cushion holder 34. In this embodiment, when the kneeling cushion portion 30 is in the first position, the concave portion 32 of the kneeling cushion portion 30 and the convex structure of the seat cushion 24 are coupled, and the rotation axis between the kneeling cushion portion 30 and the seat portion 20 passes through a front portion of the protruding portion 22 and a front portion of the concave portion 30. A tilt angle of the kneeling cushion portion 30 and a tilt angle of the seat portion 20 are synchronously changed in opposite directions.

A changing process to change the state of the multifunctional balance chair is as follows: when the rear portion of the seat portion 20 is pulled upward, the tilting angle between the kneeling cushion portion 30 and the seat portion 20 are synchronously changed in the opposite directions by the at least one synchronous connecting rod 31, and the seat portion 20 is locked when the seat portion 20 is tilted forward at an angle of 30-40 degrees.

Embodiment 2

Figure 4:
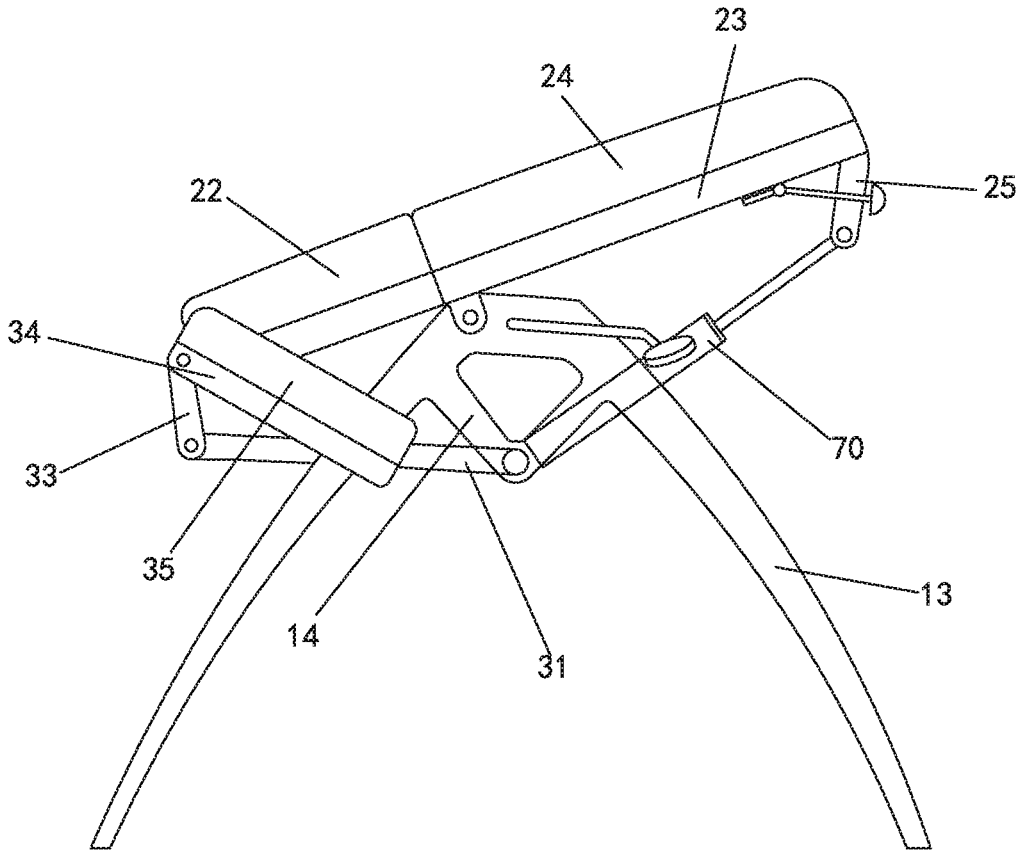
FIG. 4 illustrates a schematic view of a multifunctional balance chair of Embodiment 2 when the multifunctional balance chair is in a balance chair state.

Referring to FIG. 4 and FIG. 5, this embodiment differs from the Embodiment 1 in which the support portion 10 comprises a herringbone leg 13 and a V-shaped seat 14, and the two open ends of the V-shaped seat 14 are respectively disposed on an upper portion of the herringbone leg 13. The multifunctional balance chair further comprises an extendable mechanism 70. A first end of the extendable mechanism 70 is rotatably connected to the V-shaped seat 14 of the support portion 10, and a second end of the extendable mechanism 70 is rotatably connected to a first rear support arm 25 disposed on the rear portion of the seat portion 20. By way of example, the extendable mechanism 70 can be a hydraulic cylinder mechanism, and the second end of the synchronous connecting rod 31 is connected to the V-shaped seat 14. The first end of extendable mechanism can be rotatably connected to the support portion 10, and the second end of extendable mechanism can be rotatably connected to the rear portion of the seat portion 20. The structure of the multifunctional balance chair is simple and compact, and the multifunctional balance chair is able to be manufactured at low cost.

Embodiment 3

Figure 6:
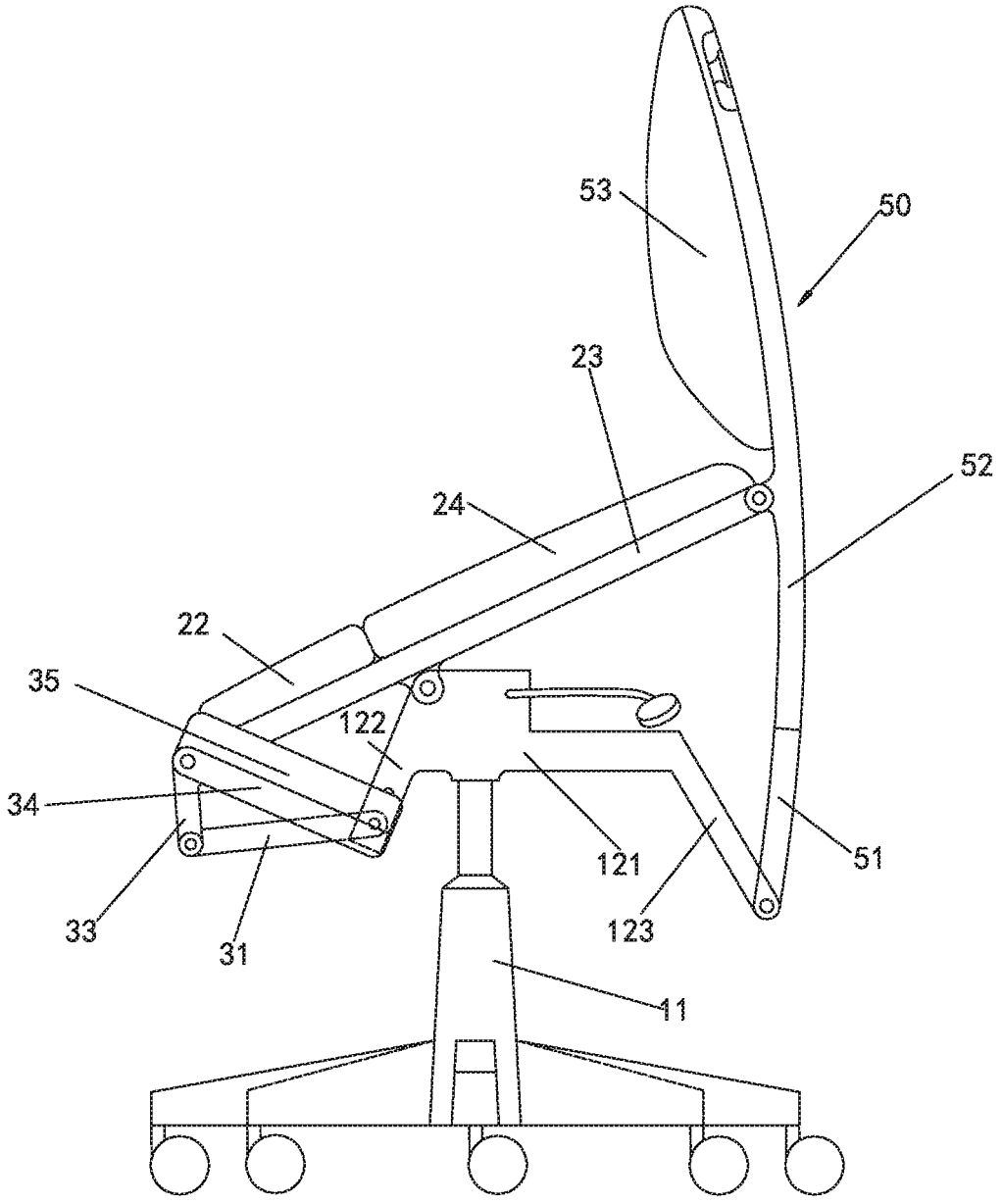
FIG. 6 illustrates a schematic view of a multifunctional balance chair of Embodiment 3 when the multifunctional balance chair is in a balance chair state.
Figure 7:
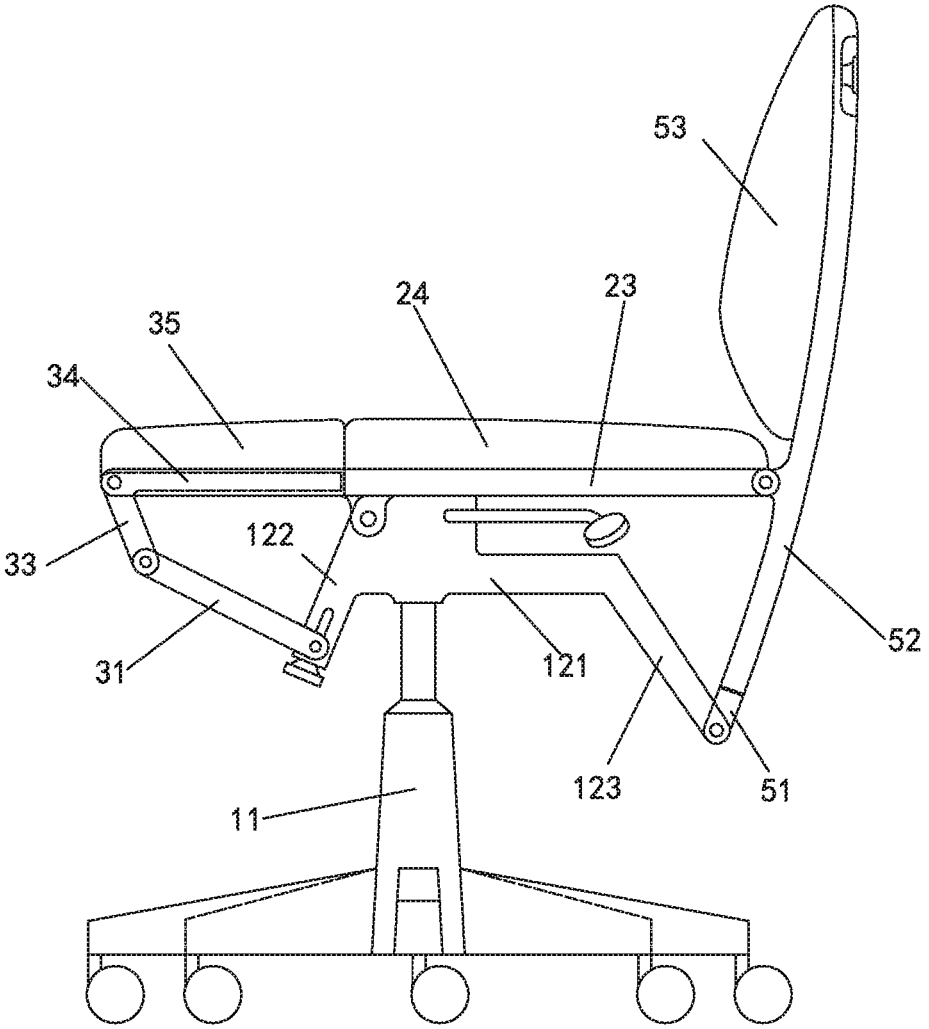
FIG. 7 illustrates a schematic view of the multifunctional balance chair of Embodiment 3 when the multifunctional balance chair is in a seat chair state.
Figure 8:
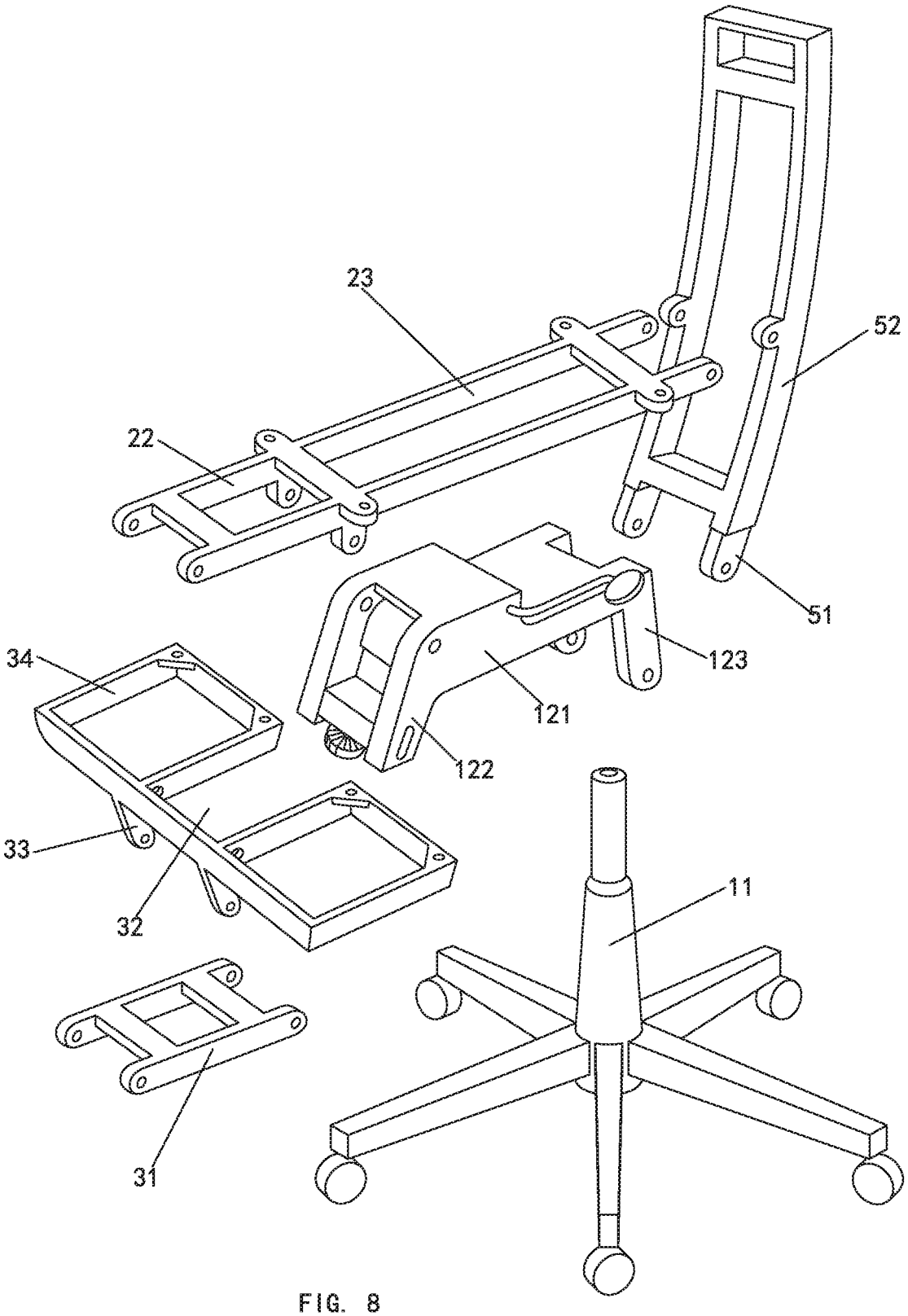
FIG. 8 illustrates an exploded view of components of a portion of the multifunctional balance chair of Embodiment 3.

Referring to FIGS. 6-8, this embodiment differs from the Embodiment 1 in that the backrest 50 comprises two second sliding bars 51 that can slide downward, and a lower end of each of the two second sliding bars 51 can be rotatably connected to a second rear support arm 123 disposed on a rear end of the disk body 121 of the support portion 10. A rear portion of the cushion bridge 23 of the seat portion 20 is rotatably connected to the backrest 50. The backrest 50 comprises two backrest bars 52 and a backrest pad 53 disposed between the two backrest bars 52. Each of the two backrest bars 52 and a corresponding one of the two second sliding bars 51 form an extendable structure. The rear portion of the cushion bridge 23 can be rotatably connected to the two backrest bars 52. Preferably, the two backrest bars 52 extend out of a lower portion of the backrest pad 53.

As needed, the at least one first locking mechanism is disposed between the seat portion 20 and the support portion 10 (for example, the disk body 121) and/or between the two backrest bars 52 and the two second sliding bars 51. The at least one first locking mechanism is configured to hold the multifunctional balance chair in the balance chair state or the seat chair state when locked, and the state of the multifunctional balance chair can be changed by unlocking the at least one first locking mechanism. Each of the at least one first locking mechanism adopts the system of a locking hole and a latch that interacts with the locking hole. Each of the at least one first locking mechanism is locked when a corresponding one of the latch is inserted into a corresponding one of the locking hole, and each of the at least one first locking mechanism is unlocked when a corresponding one of the latch is pulled out from a corresponding one of the locking hole. Further, as needed, a second locking mechanism may also be disposed between the seat portion 20 and the kneeling cushion portion 30.

Embodiment 4

Figure 9:
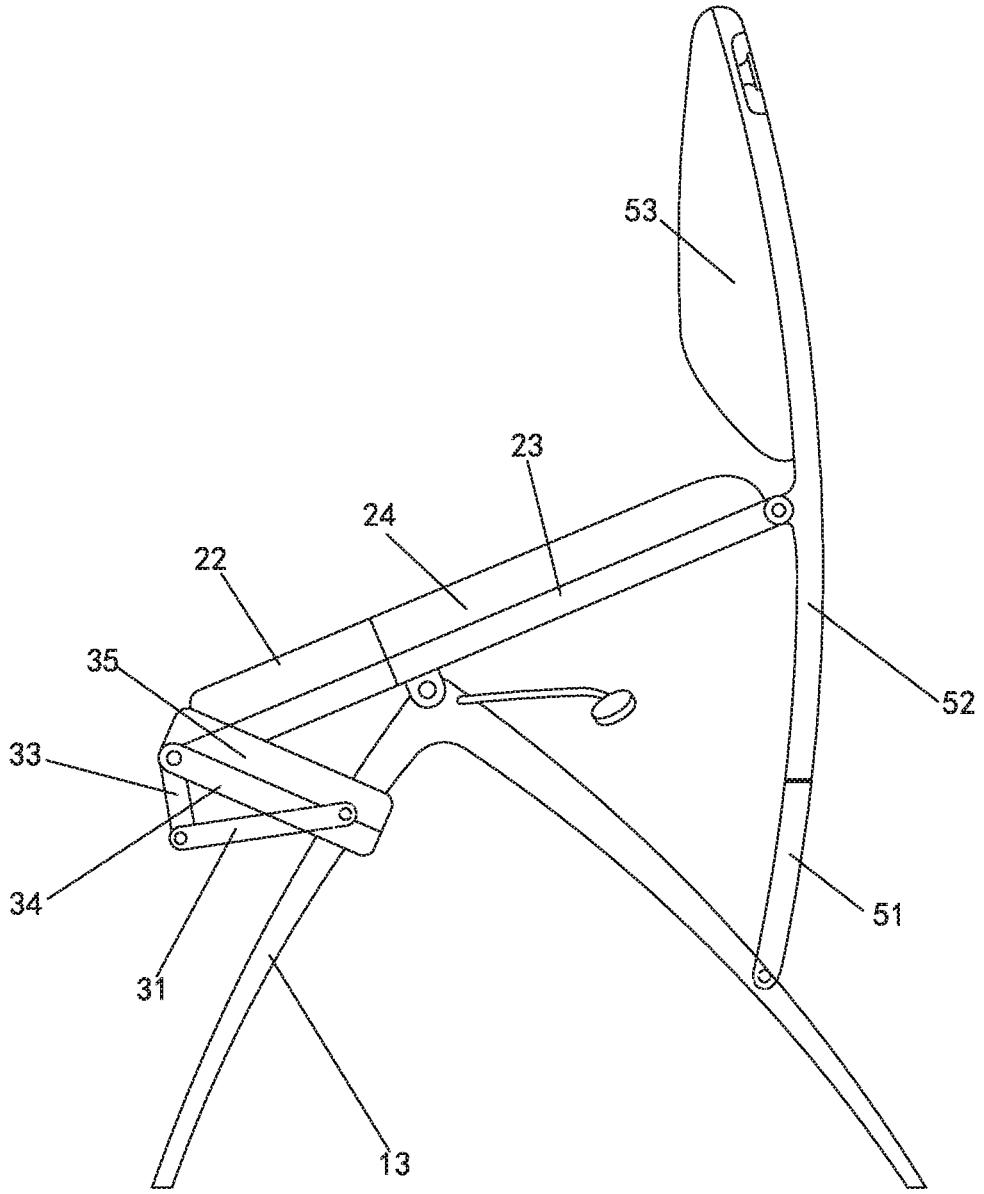
FIG. 9 illustrates a schematic view of a multifunctional balance chair of Embodiment 4 when the multifunctional balance chair is in a balance chair state.
Figure 10:
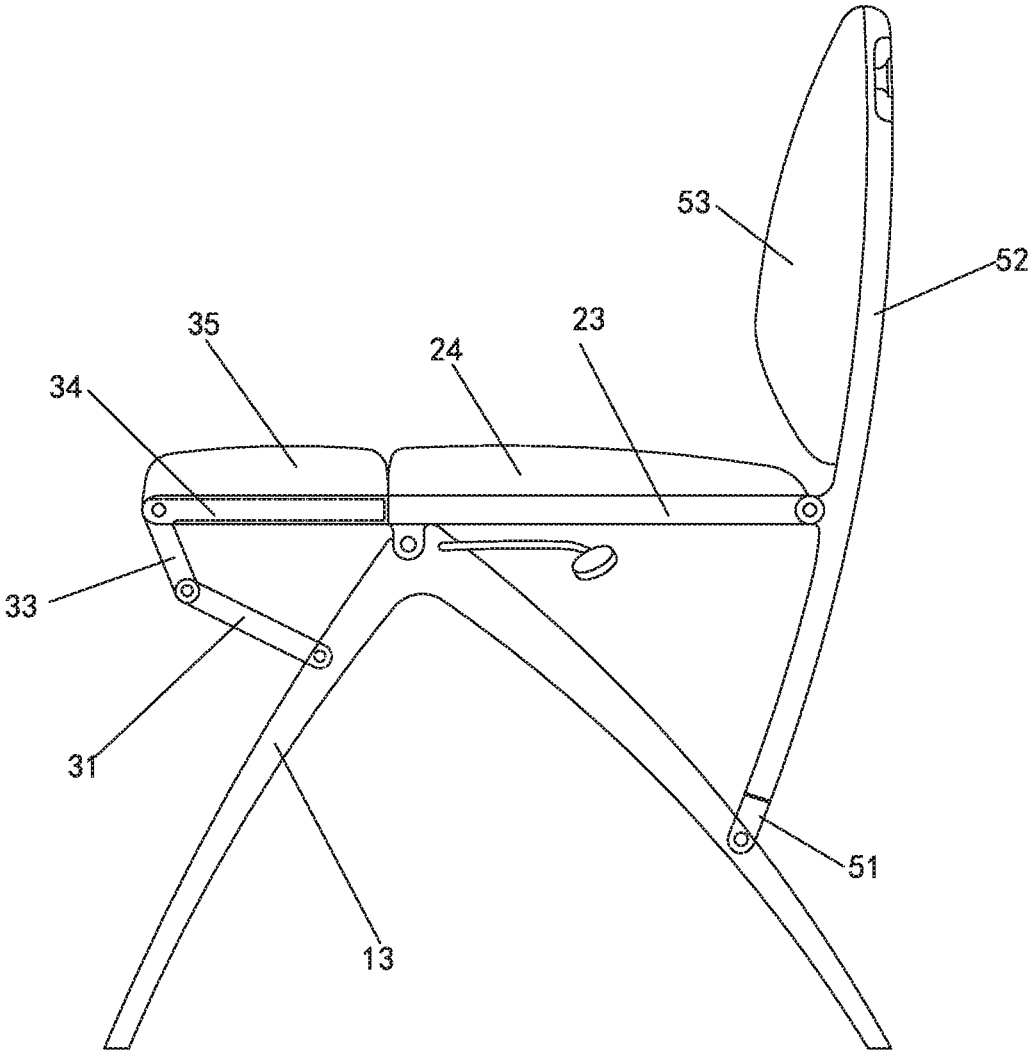
FIG. 10 illustrates a schematic view of the multifunctional balance chair of Embodiment 4 when the multifunctional balance chair is in a seat chair state.

Referring to FIG. 9 and FIG. 10, this embodiment differs from Embodiment 3 in that the support portion 10 comprises a herringbone leg 13 and the second end of the synchronous connecting rod 31 is rotatably connected to at least one front leg of the herringbone leg 13. The second sliding bar 51 can be rotatably connected to at least one rear leg of the herringbone leg 13.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

INDUSTRIAL APPLICABILITY

The present disclosure relates to the multifunctional balance chair. A design of the multifunctional balance chair is ingenious, an arrangement of the multifunctional balance chair is simple, and the multifunctional balance chair can be switched into multi positions. When the kneeling cushion portion is in the first position aligned with the seat portion, that is, when the multifunctional balance chair is in the seat chair state, the multifunctional balance chair functions as a conventional chair on the market. When the kneeling cushion portion is in the second position in which the kneeling cushion portion acts as a kneeling cushion of the multifunctional balance chair, the multifunctional balance chair is in a balance chair state such that the multifunctional balance chair functions as a conventional balance chair on the market.

What is claimed is:

1. A multifunctional balance chair, comprising:
a support portion,
a seat portion, and
a kneeling cushion portion, wherein:
the seat portion is movably connected to the support portion and movement of the seat portion is configured to control an angle between the seat portion and a horizontal plane,
the kneeling cushion portion is movably connected to the seat portion,
the kneeling cushion portion is connected to the support portion by a connecting mechanism,
the kneeling cushion portion is movable between a first position aligned with the seat portion and a second position in which the kneeling cushion portion acts as a kneeling cushion of the multifunctional balance chair,
the movement of the seat portion is linked to movement of the kneeling cushion portion,
the seat portion is rotatably connected to the support portion,
a middle portion of a front end of the seat portion is provided with a protruding portion,
a middle portion of a rear end of the kneeling cushion portion is provided with a concave portion, and
when the kneeling cushion portion is in the first position aligned with the seat portion:
the concave portion of the kneeling cushion portion is coupled to the protruding portion of the seat portion, and
a rotation axis between the kneeling cushion portion and the seat portion passes through a front portion of the protruding portion and a front portion of the concave portion.

2. The multifunctional balance chair according to claim 1, wherein:
the connecting mechanism comprises at least one synchronous connecting rod,
a first end of each of the at least one synchronous connecting rod is rotatably connected to the kneeling cushion portion, and
a second end of each of the at least one synchronous connecting rod is connected to the support portion and configured to rotate relative to the support portion.

3. The multifunctional balance chair according to claim 1, further comprising:
an extendable mechanism, wherein:
a first end of the extendable mechanism is rotatably connected to the support portion, and
a second end of the extendable mechanism is rotatably connected to the seat portion.

4. The multifunctional balance chair according to claim 1, wherein:
at least one link support arm is disposed under a front portion of the kneeling cushion portion,
the connecting mechanism comprises at least one synchronous connecting rod,
a first end of each of the at least one synchronous connecting rod is rotatably connected to a corresponding one of the at least one link support arm, and
a second end of each of the synchronous connecting rod is rotatably connected to the support portion.

5. The multifunctional balance chair according to claim 1, wherein:
the kneeling cushion portion is rotatably connected to the seat portion.

6. The multifunctional balance chair according to claim 5, wherein:
the connecting mechanism comprises at least one synchronous connecting rod,
a first end of each of the at least one synchronous connecting rod is rotatably connected to the kneeling cushion portion, and
a second end of each of the at least one synchronous connecting rod is connected to the support portion and configured to rotate relative to the support portion.

7. The multifunctional balance chair according to claim 5, further comprising:
a backrest, wherein:
the backrest comprises at least one second sliding bar configured to slide downward,
a lower end of each of the at least one second sliding bar is configured to be rotatably connected to the support portion, and
a rear portion of the seat portion is configured to be rotatably connected to the backrest.

8. The multifunctional balance chair according to claim 7, wherein:
the connecting mechanism comprises at least one synchronous connecting rod,
a first end of each of the at least one synchronous connecting rod is rotatably connected to the kneeling cushion portion, and
a second end of each of the at least one synchronous connecting rod is connected to the support portion and configured to rotate relative to the support portion.

9. The multifunctional balance chair according to claim 1, further comprising:
a bracket connected to the support portion, and
a sliding seat, wherein:
the sliding seat is slidable relative to the bracket,
the seat portion is connected to a first sliding bar that is slidable relative to the seat portion, and
the first sliding bar is connected to the sliding seat.

10. The multifunctional balance chair according to claim 9, wherein:
the bracket is shaped as an arc, and
a circle center of the arc is disposed on a rotation axis of the seat portion.

11. The multifunctional balance chair according to claim 9, further comprising:

a backrest, wherein the backrest is disposed on the bracket.

12. The multifunctional balance chair according to claim 11, wherein:

the connecting mechanism comprises at least one synchronous connecting rod, a first end of each of the at least one synchronous connecting rod is rotatably connected to the kneeling cushion portion, and a second end of each of the at least one synchronous connecting rod is connected to the support portion and configured to rotate relative to the support portion.

13. The multifunctional balance chair according to claim 9, further comprising:

two armrests, wherein the two armrests are disposed on the bracket.

14. The multifunctional balance chair according to claim 13, wherein:

the connecting mechanism comprises at least one synchronous connecting rod, a first end of each of the at least one synchronous connecting rod is rotatably connected to the kneeling cushion portion, and a second end of each of the at least one synchronous connecting rod is connected to the support portion and configured to rotate relative to the support portion.

15. The multifunctional balance chair according to claim 9, wherein:

the connecting mechanism comprises at least one synchronous connecting rod, a first end of each of the at least one synchronous connecting rod is rotatably connected to the kneeling cushion portion, and a second end of each of the at least one synchronous connecting rod is connected to the support portion and configured to rotate relative to the support portion.

16. The multifunctional balance chair according to claim 10, wherein:

the connecting mechanism comprises at least one synchronous connecting rod, a first end of each of the at least one synchronous connecting rod is rotatably connected to the kneeling cushion portion, and a second end of each of the at least one synchronous connecting rod is connected to the support portion and configured to rotate relative to the support portion.

17. A multifunctional balance chair, comprising:

a support portion, a seat portion, a kneeling cushion portion, and a backrest, wherein:

the seat portion is movably connected to the support portion and movement of the seat portion is configured to control an angle between the seat portion and a horizontal plane, the kneeling cushion portion is movably connected to the seat portion, the kneeling cushion portion is connected to the support portion by a connecting mechanism, the kneeling cushion portion is movable between a first position aligned with the seat portion and a second position in which the kneeling cushion portion acts as a kneeling cushion of the multifunctional balance chair, the movement of the seat portion is linked to movement of the kneeling cushion portion, the seat portion is rotatably connected to the support portion, the kneeling cushion portion is rotatably connected to the seat portion, the backrest comprises at least one second sliding bar configured to slide downward, a lower end of each of the at least one second sliding bar is configured to be rotatably connected to the support portion, and a rear portion of the seat portion is configured to be rotatably connected to the backrest.

18. A multifunctional balance chair, comprising:

a support portion, a seat portion, a kneeling cushion portion, a bracket connected to the support portion, and a sliding seat, wherein:

the seat portion is movably connected to the support portion and movement of the seat portion is configured to control an angle between the seat portion and a horizontal plane, the kneeling cushion portion is movably connected to the seat portion, the kneeling cushion portion is connected to the support portion by a connecting mechanism, the kneeling cushion portion is movable between a first position aligned with the seat portion and a second position in which the kneeling cushion portion acts as a kneeling cushion of the multifunctional balance chair, the movement of the seat portion is linked to movement of the kneeling cushion portion, the sliding seat is slidable relative to the bracket, the seat portion is connected to a first sliding bar that is slidable relative to the seat portion, and the first sliding bar is connected to the sliding seat.

19. The multifunctional balance chair according to claim 18, wherein:

the bracket is shaped as an arc, and a circle center of the arc is disposed on a rotation axis of the seat portion.

20. The multifunctional balance chair according to claim 18, further comprising:

a backrest, wherein the backrest is disposed on the bracket.

* * * * *